United States Patent [19]

Pair

[11] Patent Number: 4,531,438

[45] Date of Patent: Jul. 30, 1985

[54] ANTIKICKBACK HOLD-DOWN SAFETY DEVICE FOR TABLE SAWS

[75] Inventor: Louis C. Pair, Kingston, Tenn.

[73] Assignee: Joe H. Walker, Harriman, Tenn.

[21] Appl. No.: 607,145

[22] Filed: May 4, 1984

[51] Int. Cl.[3] ..... B26D 7/06; B27B 25/06

[52] U.S. Cl. ..... 83/156; 83/102.1; 83/442; 83/444; 83/447; 83/450; 83/422; 144/249 R; 29/121.4

[58] Field of Search ..... 83/422, 440, 424, 441, 83/441.1, 444, 447, 448, 450, 436, 156, 102.1; 144/246 A, 246 D, 247, 249 R, 253 F; 29/121.4

[56] References Cited

U.S. PATENT DOCUMENTS

| | | | |
|---|---|---|---|
| 245,072 | 8/1881 | Jennings | 29/121.4 X |
| 470,724 | 3/1892 | Veach | 83/448 X |
| 1,744,874 | 1/1930 | Edwards | 144/249 R |
| 2,646,088 | 7/1953 | Smith | 144/249 R |
| 2,801,656 | 8/1957 | Ford | 83/447 X |

*Primary Examiner*—James M. Meister
*Assistant Examiner*—John L. Knoble
*Attorney, Agent, or Firm*—Herman L. Holsopple, Jr.

[57] ABSTRACT

The present invention is directed to a safety device for standard table-mounted saws whereby a board is firmly restrained thereon while the sawblade rotates to saw the board in a longitudinal plane. The device utilizes a pair of vertically oriented, spring-loaded, hold-down assemblies to maintain the board in longitudinal alignment with the rotating blade. The hold-down assemblies are of a generally rectangular configuration and may be conveniently mounted perpendicular to and at longitudinally spaced apart locations with respect to the board. The device of the invention is a significant improvement in safety equipment designed to prevent the sawed sections of a board from kicking back onto the operator of conventional table saws.

3 Claims, 2 Drawing Figures

ANTIKICKBACK HOLD-DOWN SAFETY DEVICE FOR TABLE SAWS

BACKGROUND OF THE INVENTION

The subject invention relates, generally, to power table saws and, more specifically, to a safety device for holding the material being cut by said saw to the table on which the saw is mounted and whereupon the operation takes place. It is an important object of this invention to keep boards from kicking back toward the operator during the sawing process.

When cutting, ripping or otherwise shaping boards on table-mounted rotary saws or shapers, a kickback of the piece occurs when the saw blade becomes hung in the board whereupon the board is rapidly propelled backward into the operator. In the past, users of power table saws have used blocks of wood to hold the piece in place and to push the piece through the rotating saw. Such makeshift devices have proved to be inadequate for retaining the boards during an entire cut and, especially, have not solved the problem, in very long cuts, of holding material in place while the operator walked around the saw to pull the piece through the machine.

Various devices and methods have been developed in the past to try to alleviate the problem of kickback. U.S. Pat. No. 2,676,625 describes a device having a series of upper and lower rollers disposed from a header on either side of the saw blade together with pivotally mounted finger elements for restraining the board. U.S. Pat. No. 4,212,214 describes an antikickback device for use with radial arm saws and requiring a splitter portion to prevent binding. U.S. Pat. No. 2,823,711 describes an adjustable splitter blade assembly for preventing kickback in table saws. None of the foregoing patents anticipate the subject invention wherein two board-restraining components removeably attached to a standard table rip fence of a conventional table saw at variable predetermined positions fore and aft of the saw blade and having safety shields disposed therein provide, not only absolute board-restraining capability, but full assurance against kickback.

SUMMARY OF THE INVENTION

It is an important object of the subject invention to provide an economical, conveniently attachable, combination antikickback and hold-down device for use with either table-mounted rotary saws or table-mounted rotary shapers.

It is another object of this invention to provide an antikickback hold-down device which is simple to use, readily adjustable and flexible in both placement and operation.

DESCRIPTION OF THE PREFERRED EMBODIMENT OF THE INVENTION

Figure 1:
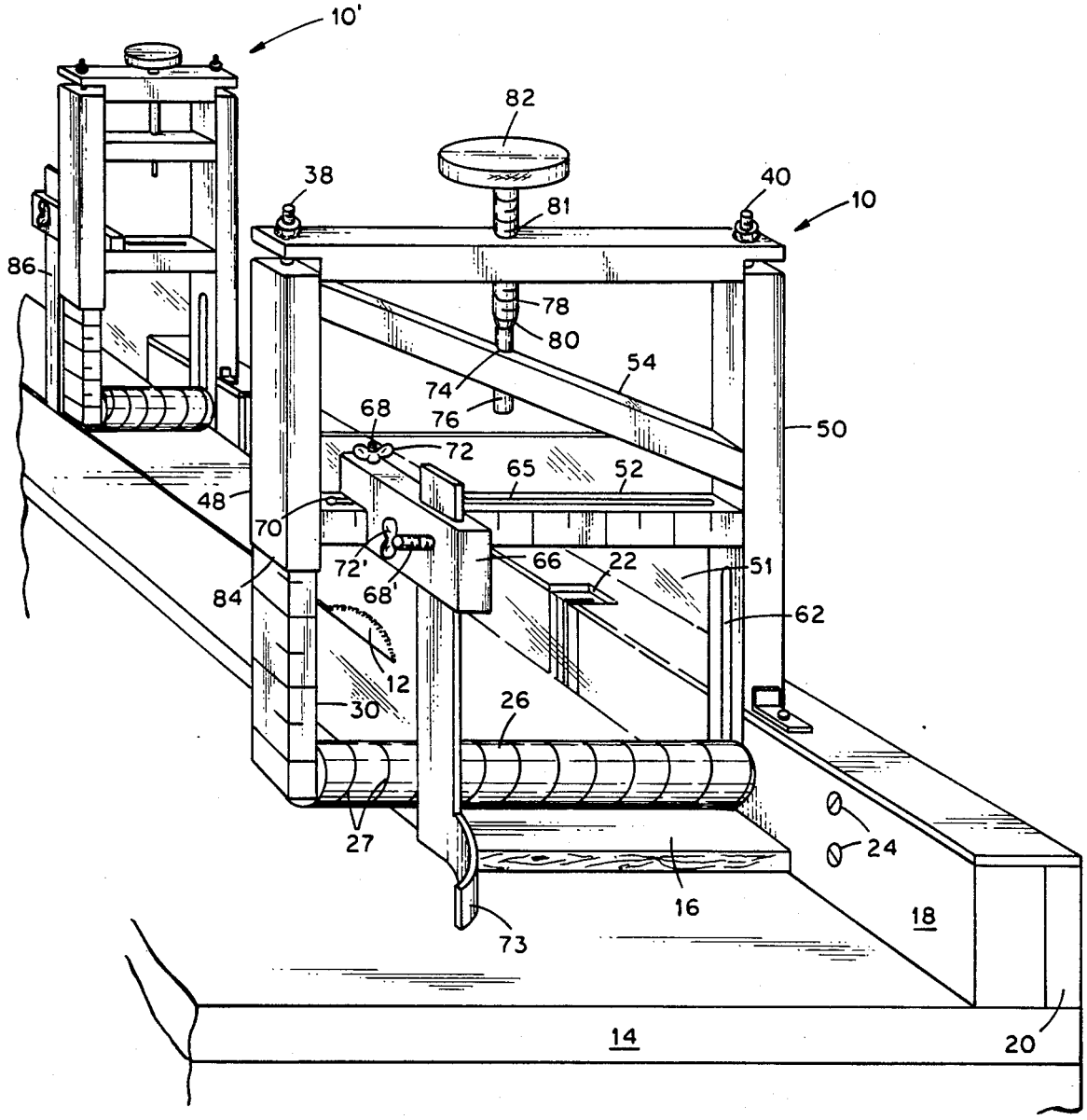
FIG. 1 is a perspective view of this invention mounted on a rotary saw or shaper table.

Referring to the perspective view of FIG. 1, the subject antikickback, hold-down safety device for use with a table-mounted saw having a horizontal table for supporting a workpiece and a blade rotatable in a longitudinal plane comprises a pair of generally rectangular, vertically oriented workpiece hold-down assemblies 10, 10' formed from metal having tubular and/or solid cross sections, said vertical assembly 10 being detachably mounted anterior to table saw blade 12 and vertical assembly 10' being detachably mounted posterior to blade 12. While, for clarity, only the components of hold-down assembly 10 are numbered in FIG. 1, it is to be understood that hold-down assembly 10' is of similar construction and has similar parts. Table saw blade 12 is of a type commonly mounted beneath a saw table 14 whereby the workpiece board 16 may be fed thereover and be cut to a predetermined size.

As seen in the drawings, vertical assemblies 10, 10' comprise a pair of spaced apart vertically oriented elongated members of tubular cross section detachably mounted to a common horizontal support member 18 which is fixedly mounted to a standard table rip fence 20 which, in turn, is adjustably mounted to saw table 14. Horizontal support member 18 is provided with multiple mating sockets 22 whereby vertical assemblies 10, 10' can be detachably mounted thereto at varied distances from saw blade 12, depending upon the cutting requirements for board 16. Horizontal support member 18 is fixedly mounted to standard table rip fence 20 by means of bolts 24, said table rip fence 20 being detachably mounted by conventional means to either the right side of, or to the left side of, saw blade 12 depending on whether the operator is left-handed or right-handed.

Figure 2:
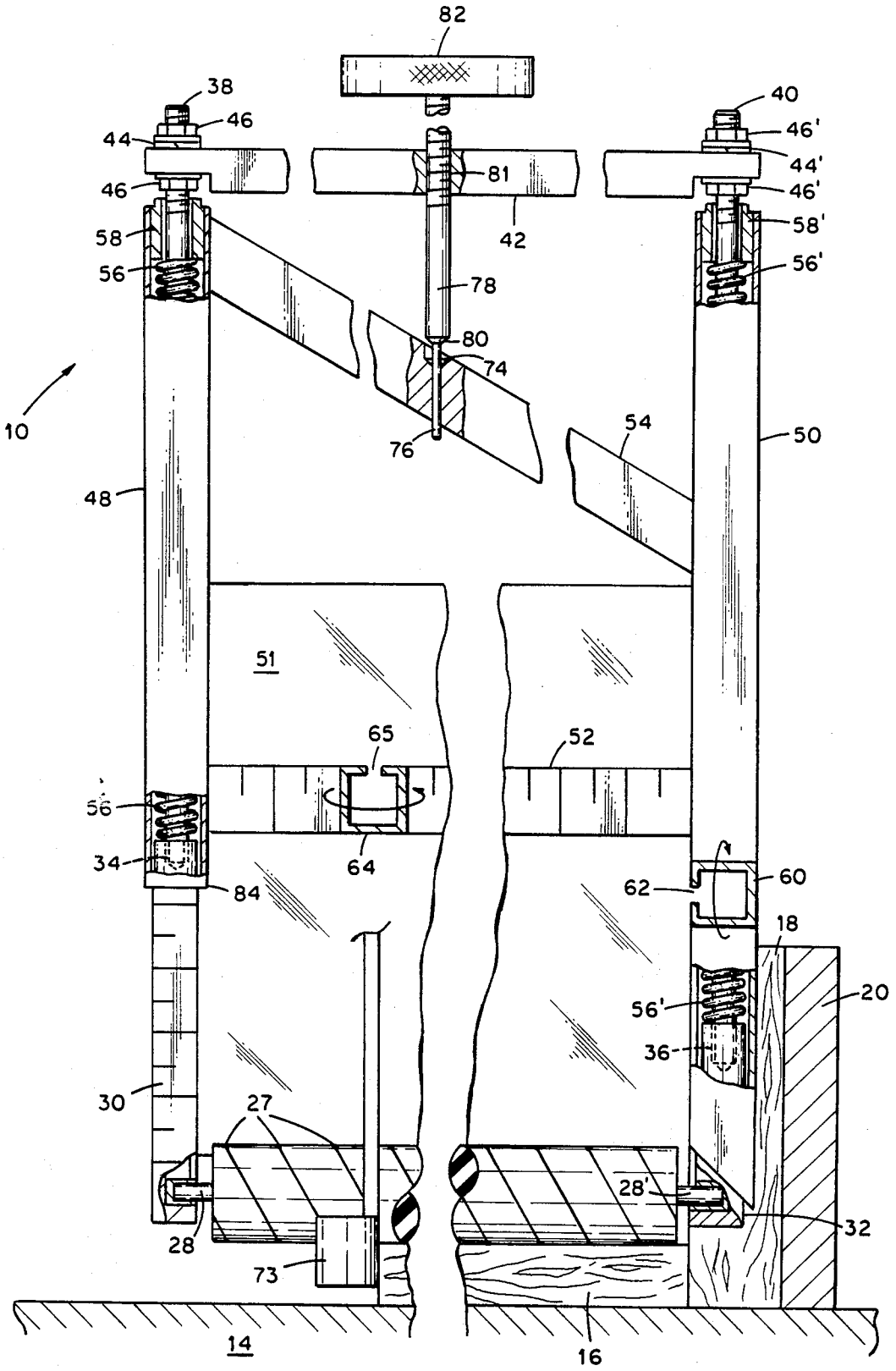
FIG. 2 is a sectional view of the subject hold-down device showing its assembly, exploded to show internal construction.

Vertical assembly 10, as seen in FIG. 1 and the cross-sectional view of FIG. 2, is comprised of a cylindrical, elongated resilient roller 26 affixed at each end thereof by axle 28, 28' journaled into vertically displaceable outer member 30 having a calibrated scale thereon, and vertically displaceable inner member 32, respectively. Elongated roller 26 is adapted to be positioned over the workpiece in a contacting relationship therewith and having bias means operatively associated with vertically displaceable members 30, 32 for urging said roller 26 in a vertical direction towards table 14 to bear against said workpiece with sufficient force to inhibit kickback. Elongated resilient roller 26 may be constructed of hard rubber, polyurethane or other equally compressible material for restraining the workpiece.

Vertical displaceable members 30, 32 are preferably of solid square cross section and have threaded holes 34, 36 at the top portion thereof for receiving threaded shafts 38, 40, respectively. Vertical displaceable members 30, 32 are secured to each other by means of top horizontal cross member 42 through the ends of which pass threaded shafts 38, 40. Top cross member 42 is fixed to threaded shafts 38, 40 by means of lock washers 44, 44' and lock nuts 46, 46', respectively.

Assembly 10 is further comprised of two vertical elongated fixed members 48, 50 having tubular cross sections superimposed, as shown in the cross-sectional partially cut-away drawing of FIG. 2, over vertical displaceable members 30, 32. Tubular members 48, 50 are fixedly joined by a lower tubular horizontal cross member 52 having calibrated indices scribed thereon and by horizontal central cross member 54. Tubular members 48, 50 are each supplied internally with a spring 56, 56', respectively. Springs 56, 56' extend from the top of the pair of vertically displaceable members 30, 32 to force-fit bushings 58, 58' at the top of the pair of vertically oriented tubular members 48, 50, respectively. Bushings 58, 58' have a round hole extending therethrough for the free passage of shafts 38, 40 and supply the restraining shoulder for springs 56, 56', respectively. A transparent safety shield 51, preferably constructed of any convenient suitably thick, transparent, impact-resistant plastic, is slidably and detachably mounted to vertical fixed members 48, 50 of vertical hold-down assembly 10 whereby the operator is further protected during the operation of the saw.

As seen in FIG. 2, a revolved section 60 of tubular member 50 shows a slot 62. Slot 62 extends from the lowermost portion of tubular member 50 at a point adjacent to shaft 28', then upwardly to a point just beneath cross member 52. The presence of springs 56, 56' in tubular members 48, 50, respectively, and the placement of slot 62 in tubular member 50 provides roller 26 with the resilience and freedom to move vertically whether being compressed downwardly by the force of springs 56, 56' or upwardly by the pressure of the workpiece board 16. Since tubular member 48 extends to a point just slightly below cross member 52, member 48 does not require a slot comparable to that of tubular member 50.

Lower horizontal cross member 52 joining fixed tubular members 48, 50 is of tubular cross-section, and as is shown in the revolved section 64 of member 52, has a central slot 65 (FIG. 2) along most of the entire upper surface thereof (FIG. 1) to hold the adjustable pressure bar holder 66 seen in the drawings. The cap (not shown) of bolt 68 is placed into opening 70 at one end of slot 65 whereby bolt 68 is retained by slot 65 and whereby bolt 68 and wing nut 72 are the means for moveably retaining pressure bar holder 66 to lower cross member 52.

As seen in FIG. 1, a pressure bar 73 is adjustably retained in pressure bar holder 66 by means of wing nut 72' and bolt 68'. Lower horizontal tubular cross member 52 is calibrated whereby the distance between pressure bar 73 and horizontal support member 18 can be readily ascertained. This, for most purposes, indicates the width of the workpiece. Vertical assemblies 10, 10' are designed whereby pressure bar holder 66 can be mounted onto either side of the anterior vertical assembly 10 or the posterior vertical assembly 10'. Optionally, instead of utilizing pressure bar holder 66 as only a holder for pressure bar 73, to prevent lateral board movement, a conventional splitter bar 86 may be utilized on posterior vertical assembly 10' to provide good separation for the two parts of the board as it is being cut.

As previously described, wing nuts 72, 72' on bolts 68, 68' provide the adjustments necessary for moving pressure bar holder 66 both laterally along slot 65 in lower cross member 52 and for regulating the height of pressure bar 73 in said pressure bar holder 66, respectively. The horizontal adjustment of holder 66, when made in conjunction with scaled lower cross member 52 and the vertical adjustment of pressure bar 73 (or a splitter bar), in combination, prevent binding of the saw or shaper blade.

Central horizontal cross member 54 is preferably of solid cross section with a centered countersunk hole 74 drilled therethrough to permit free and unobstructed movement of the small end 76 of threaded shaft 78 up to the tapered bearing portion 80 thereof. Tapered portion 80 of shaft 78 is used as a bearing against the coutersunk top of hole 74. As seen in FIG. 2, most of the upper portion of shaft 78 is threaded to match threaded opening 81 in top cross member 42 and whereby compression control knob 82 at the terminal end of shaft 78 can be used to apply spring-loaded pressure through top cross member 42 to compress springs 56, 56' thereby exerting a downward force on resilient roller 26 to accomplish one of the primary objectives of this invention.

It may be helpful to describe in further detail the adjustment mechanism for selectively varying the force exerted by roller 26 against workpiece 16. When compression control knob 82 is turned clockwise, tapered portion 80 of shaft 78 presses downward on the countersunk portion of hole 74. As compression control knob 82 is further turned in a clockwise direction, top cross member 42 rises and, along with it, threaded shafts 38, 40 are elevated, pulling with them vertically displaceable members 30, 32 to which shafts 38, 40 are, respectively, threadedly attached. The upward movement of vertical members 30, 32 carries with it axle 28, 28' along with roller 26 attached thereto. This upward movement compresses springs 56, 56' thereby producing a downward force component in roller 26 which is also one of the objectives of the invention.

In practice, compression control knob 82 is turned until the approximate thickness of the board to be sawed or shaped is indicated by lower frame edge 84 on the calibrated scale of member 30. At this point, the resistance of resilient roller 26 to further upward motion is equal to the product of two times the spring constant (typically, 8–12 pounds per inch) of springs 56, 56' times the amount of spring compression in excess of the board thickness, assuming negligible friction and that the springs balance the weight of the associated parts. The ability of roller 26 to exert a downward force which is directly proportional to the amount of spring compression together with the resiliency of said roller 26 are fundamental to the ability of the invention to function for the purposes intended, i.e., to provide strong hold-down and antikickback forces which are fully adequate to restrain a board during a sawing or shaping operation and without marring its surface.

An important feature of the invention is the presence on the surface of resilient roller 26 of spiral grooves 27 which enable said roller to "grip" the workpiece board more firmly as well as help to direct the sawdust produced by the cutting action of the saw away from the operation.

For a fuller understanding of the invention it is essential to know that vertical hold-down assemblies 10, 10' may be of any convenient height and width compatible with the saw table and may be easily mounted on the commercial rip fence by the method described herein or by any other equally convenient method. While the embodiment set forth in this disclosure, utilizing recessed mating sockets, is a preferred method for mounting the subject vertical assemblies to a common horizontal support member and thence to the table rip fence, any alternative or convenient means for fixedly attaching the hold-down devices described herein to a saw table would be satisfactory for accomplishing the outlined purpose of the invention.

It will be seen from the foregoing description and drawings that a simple and effective means is provided for conveniently attaching an antikickback safety device to a standard table saw whereby a board may be firmly retained while the saw is in operation. The device utilizes two vertically oriented, detachably mounted, spring-loaded hold-down components to maintain the workpiece in longitudinal alignment with the rotating saw blade whereby the sawed sections of said workpiece cannot kick back onto the machine operator.

A preferred embodiment of this invention has been set forth in the description and drawings. These descriptions are used in the generic sense and not for purposes of limitation. Various design and structural changes may be made in the described components without departing from the spirit and scope of the invention.

What is claimed is:

1. In an antikickback safety apparatus for use with a table-mounted saw having a horizontal table for supporting a workpiece and a blade rotatable in a longitudinal plane and disposed in a working relationship with said table; the improvement comprising a pair of detachable vertically oriented workpiece hold-down assemblies of a generally rectangular configuration disposed above said table and perpendicular to the workpiece at longitudinally spaced apart locations to said blade and oriented perpendicular to said plane, each assembly comprising: a pair of spaced apart fixed vertical elongated members, said top horizontal cross member having two ends; a pair of threaded shafts having two ends disposed within said fixed vertical elongated members, said shafts being threadedly attached at the first ends thereof to the ends of said top horizontal cross member, said shafts being threadedly attached at the second ends thereof to each of said vertically displaceable members; a central cross member between said fixed vertical elongated members; a cylindrical resilient roller means having a raised spiral surface thereon and being affixed at each end thereof to one of the vertically displaceable members and adapted to be positioned over said workpiece in a contacting relationship therewith; bias means operatively associated with the vertically displaceable members for urging said roller means in a vertical direction towards the table to bear against said workpiece with sufficient force to inhibit kickback, and adjusting means arranged to adjust the bias means for selectively varying the force exerted by said roller against said workpiece.

2. The apparatus of claim 1 wherein the bias means operatively associated with a pair of vertically displaceable members for urging said roller means in a vertical direction toward the table to bear against said workpiece comprises a pair of compression springs encompassing the length of said threaded shafts, said springs and shafts extending from the top of the pair of vertically displaceable members to the top of a pair of fixed vertical elongated members of tubular cross section, said vertically displaceable members being free to travel vertically inside said fixed vertical elongated members within the constraints of the springs therein.

3. The apparatus of claim 1 wherein the adjusting means for selectively varying the force exerted by said roller means against said workpiece comprises a compression knob on a shaft threaded centrally through said top horizontal cross member, said shaft having a bearing surface onto said central cross member whereby pressure applied thereto by turning said knob in a clockwise direction forces said top horizontal cross member upward thereby placing said springs into compression within said fixed vertical elongated members.

* * * * *